United States Patent [19]

Hanke et al.

[11] 3,990,644

[45] Nov. 9, 1976

[54] LIFTING WALL FOR TUBE MILLS

[75] Inventors: Heinz Hanke, Ennigerloh, Germany; Theodor Lutke-Cossmann, deceased, late of Vorheim, Germany, by Magdalene Lutke-Cossmann, heir

[73] Assignee: Polysius AG, Neubeckum, Germany

[22] Filed: July 24, 1975

[21] Appl. No.: 598,842

[30] Foreign Application Priority Data

July 25, 1974 Germany ..... 2435930

[52] U.S. Cl. ..... 241/171; 241/181

[51] Int. Cl.[2] ..... B02C 17/02

[58] Field of Search ..... 241/70–72, 241/76, 78, 79.2, 78.3, 171, 179, 181, 284

[56] References Cited

UNITED STATES PATENTS

| | | | |
|---|---|---|---|
| 2,259,769 | 10/1941 | New House | 241/70 |
| 3,219,284 | 11/1965 | Fahlstrom et al. | 241/70 |
| 3,601,323 | 8/1971 | Giencke | 241/171 X |
| 3,799,458 | 3/1974 | Cossmann | 241/181 X |
| 3,801,025 | 4/1974 | Slegten | 241/181 X |

*Primary Examiner*—Granville Y. Custer, Jr.
*Assistant Examiner*—Howard N. Goldberg
*Attorney, Agent, or Firm*—Learman & McCulloch

[57] ABSTRACT

A lifting wall adapted to be incorporated in a rotary tube mill comprises an annular support frame defined by a pair of spaced apart discs between which is secured a plurality of circumferentially spaced, radial lifting blades. The radially outer end of each blade is fixed to the discs, but the radially inner end of each blade is slidable relative to the discs so that the blade can expand and contract according to temperature variations.

12 Claims, 2 Drawing Figures

FIG.1
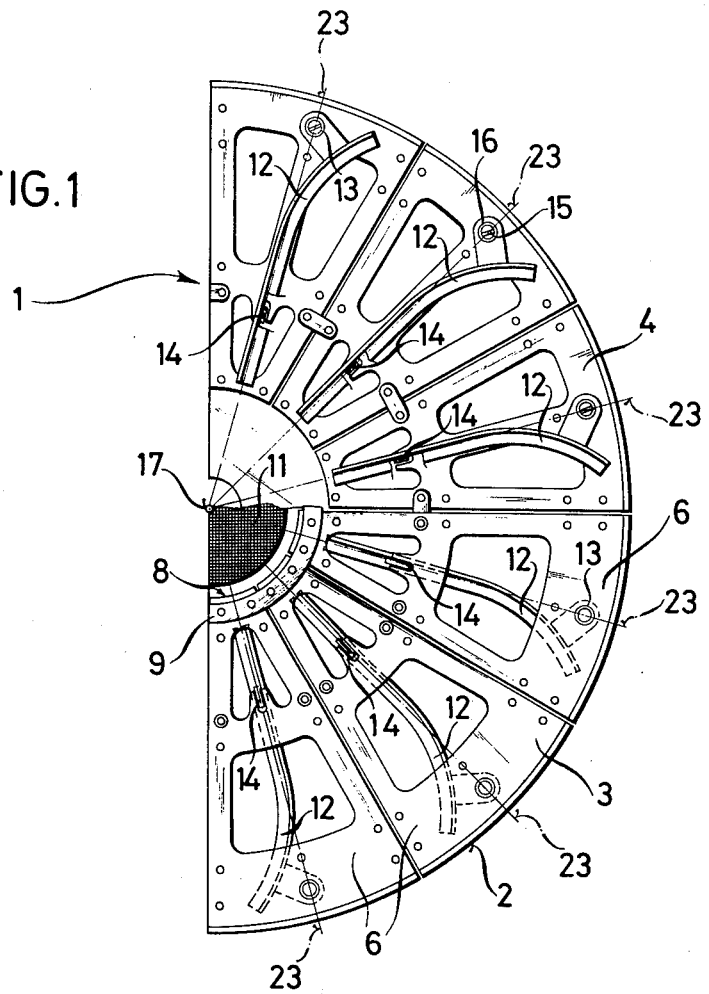
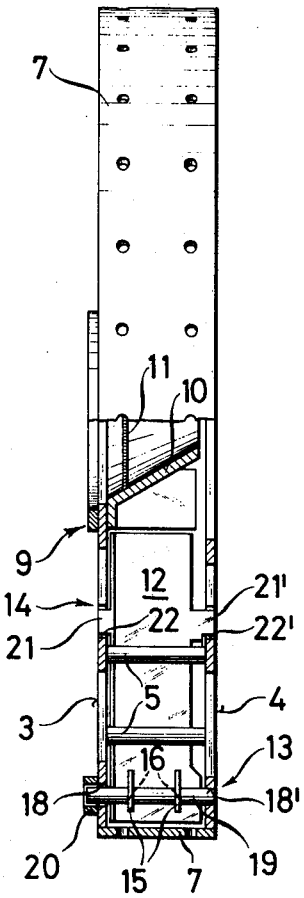
FIG.2

LIFTING WALL FOR TUBE MILLS

This invention relates to a lifting wall, especially for incorporation on a tube mill, with an annular support frame having a transfer cone coaxially disposed in the lifting wall, two circular support discs spaced apart from each other and consisting of individual segments, and a plurality of lifting blades provided between the support discs, the blades being distributed in the peripheral direction of the support frame and extending from the outer peripheral area of the frame to the area of the transfer cone.

A number of lifting wall constructions of the general type to which the invention relates are already known, and are incorporated as intermediate or end walls in a tube mill, wherein on the support frame or on the circular support discs thereof are mounted plates, provided for instance with apertures, through which apertures ground material reaches the lifting wall, where it is conveyed by the lifting blades to the centrally disposed transfer cone which in turn conveys the ground material into an adjacent grinding chamber or out of the mill.

Since increasingly large outputs are being aimed at nowadays, the tube mills and hence their components, such as the lifting walls, must necessarily be also made correspondingly bigger. In general the lifting walls are subject to stresses arising from the contents of the grinding chamber (grinding bodies plus material being ground) and to differential thermal extensions in at least some parts of the lifting wall. In this latter connection one must especially mention the lifting blades, which in known constructions are rigidly affixed to the support frame (by welding or multiple bolts), and under heavy stresses, especially in heated mills, very often have a tendency to crack leading even to breakage of the blades themselves or of the support frame.

This invention therefore has for its objective the provision of a lifting wall of the type described which avoids the stresses in the lifting blades especially caused by thermal expansion, and at the same time ensures that the individual blades can readily be assembled or exchanged.

According to the invention this objective is achieved in that each lifting blade is held in place between the support discs firstly by a fixed support point and secondly by a movable support point which permits the lifting blade to slide in its longitudinal direction.

This construction as provided by the invention offers the advantage that each lifting blade can expand freely, especially in its longitudinal direction, without leading to stresses between the blades and the support frame or the support discs thereof. Because of this construction as provided by the invention, wherein the lifting blades and the support frame are not rigidly joined together, at the same time any deformation of the mill cylinder can be kept separate from the lifting blades.

Through the disposition of the individual lifting blades between the support discs with the aid of only two support points (fixed support point and movable support point), when a new lifting wall is being made the lifting blades can easily be incorporated in the support frame, and on replacement of worn parts a lifting wall can be rapidly and easily replaced.

One embodiment of the invention will be described in more detail below with reference to the drawings, wherein:

FIG. 1 is a partial end view (only a semi-circle) of a lifting wall as provided by the invention; and FIG. 2 is a partly sectioned longitudinal view of the lifting wall shown in FIG. 1.

The lifting wall 1 constructed in accordance with the invention and intended for incorporation in a tube mill includes a support frame 2 having two circular support discs 3, 4 (see FIG. 2) spaced a distance apart (an axial spacing in relation to the lifting wall as a whole), the distance being maintained by spacer struts 5, so that these support discs 3, 4 are generally parallel to each other. Each support disc 3, 4 is built up of individual segments 6. In FIG. 1 some of the segments 6 of the one support disc (e.g., 3) are omitted to make the invention clearer. The number of segments 6 in a support disc will in general depend on the construction of the lifting wall. For example in the drawing (FIG. 1) the number of segments in a support disc has been chosen as twelve.

The segments 6 in each support disc 3, 4 have the same angular dimensions and are preferably opposite each other in pairs. In the vicinity of the outer rim they can be affixed together by a connecting web 7 which can be bolted to the tube mill casing.

In the vicinity of the inner periphery of the support discs 3, 4 a central aperture 8 is formed in the lifting wall. In this area the segments 6 of the disc 3 are somewhat longer than those of the disc 4, with the somewhat longer segments 6 of the disc 3 held in a clamping ring 9 which also holds the flange of a transfer cone 10, which is of hollow shape, extends axially through the lifting wall 1 and hence extends from the vicinity of the clamping flange to the axially opposite side of the lifting wall. In the transfer cone 10, which is open at both ends, there is inserted a grid 11 which prevents the passage of solid material but allows gas to flow through.

Between the support discs 3, 4 the support frame 2 has a number of lifting blades 12 distributed uniformly in the peripheral direction of the support frame and extending in the gap between the support discs 3, 4 from about the outer rim of the support frame to the vicinity of the transfer cone 10. In the area of the outer rim of the support frame 2 the lifting blades 12 provided in this case are arcuate, while over their remaining length they are generally straight, extending radially of the lifting wall 1. It is obviously also possible to use other suitable forms of blade.

Each lifting blade 12 is held between the support discs 3, 4 by means of two support points, firstly by a fixed support point 13 in the vicinity of the outer rim and secondly by a movable support point 14 provided in the area of that portion of the lifting blade 12 which faces the transfer cone 10 and which permits the lifting blade to slide in its longitudinal direction.

The fixed support point 13 for a lifting blade 12 has at least one support web 15 affixed to the lifting blade; in the embodiment shown in the drawings there are provided two such support webs 15 which project from the lifting blade and each have a bearing hole 16, the holes 16 in the two webs being aligned with each other and their common axis being generally parallel to the lifting wall axis 17. Two holes 18, 18′ of substantially equal size are provided coaxially with these support web holes 16 in oppositely disposed segments 6 of the support disc 3, 4. Through these four holes 16, 16′, 18, 18′ passes a support pin 19 having its one end flush with the outside of the support disc 4, while its other end projects slightly outward from the other support disc 3 and is welded into a ring 20 which in turn is welded to the outside of the support disc 3.

At least at one axial end of the lifting blade 12 the movable support point 14 has a guide projection 21. In the embodiment shown, two oppositely disposed guide projections 21, 21' are provided at each axial end of the lifting blade 12. Each guide projection is formed as a straight guide lug 21, 21' running generally radially to the lifting wall 1 and engaging in a guide slot 22, 22' provided in the corresponding support disc 3, 4 and also extending generally radially to the lifting wall, the slot being preferably open toward the one radial end so that the guide lug can be slid therein in the radial direction in simple manner. In the embodiment shown in the drawings there is a greater space between the disc 4 and the blade 12 than there is between the blade and the disc 3. Extending between the blade and the disc 4 is a guide lug 21'; preferably of L-shape (see FIG. 2), whereby the lug 21' has a shoulder engageable with the inside of the support disc 4 to act as a spacer member.

With the lifting wall 1 provided by the invention, a lifting blade 12 can be inserted in extremely simple manner into the gap between two support discs 3 and 4, or if necessary be removed therefrom. In any case the movable support point 14 for each lifting blade 12 permits longitudinal extension or shortening of the blade such as can occur with marked temperature variations. But because of the fixed support point 13 each lifting blade 12 is stabilized in the peripheral direction of the support frame 2 and also radially of the frame. Since the lifting blade 12 with its support webs 15 is mounted relatively loosely on the support pin 19, in the outer peripheral area of the suppport frame 2 it has a relatively fixed positional arrangement, but not a firm and rigid connection to that frame. In this embodiment of the invention the lifting blades 12 are thus in practice only loosely suspended, without thereby forfeiting their desired constant disposition within the lifting wall 1.

As may be seen clearly from FIG. 1, only one lifting blade 12 is provided between each pair of segments from the oppositely disposed segments 6 of the two support discs 3, 4. In this embodiment it is found that for each segment 6 of the support discs 3, 4 both the holes 18, 18' for the support pin 19 and also the guide slots 22, 22' for the movable support point lie on the central longitudinal axis 23 of each segment 6. Hence all the segments 6 can be made of like shape, which has a special advantage with suppport discs wherein the individual segments must all be of equal size.

It is possible to provide two or more lifting blades between a pair of segments, and in such event the holes and guide slots for the fixed and movable support points can obviously also be disposed symmetrically with the central longitudinal axis of the segments.

What is claimed is:

1. A lifting wall adapted for incorporation on a tube mill comprising a pair of spaced apart, annular support discs joined at their peripheries by a cylindrical web and having a transfer cone adjacent their centers; a plurality of circumferentially spaced lifting blades interposed between said discs, each of said blades extending generally radially of said discs from adjacent the peripheries of said discs toward the centers of said discs; first mounting means mounting each of said blades adjacent one end thereof on said discs; and second mounting means mounting each of said blades adjacent its other end on said discs, one of said mounting means fixing the associated end of said blade radially of said discs and the other of said mounting means enabling movement of the adjacent end of said blade radially of said discs, whereby each of said blades is expansible and contractile radially of said discs.

2. A lifting wall according to claim 1 wherein said one of said mounting means is said first mounting means.

3. A lifting wall according to claim 1 wherein said first mounting means is adjacent the peripheries of said discs.

4. A lifting wall according to claim 1 wherein said first mounting means comprises at least one support web carried by each blade, and a pin extending through openings in said discs and said support web.

5. A lifting wall according to claim 1 wherein said slidable second mounting means comprises guide slots in said discs and projections on each blade extending into said slots, said slots having a greater length radially of said discs than said projections.

6. A lifting wall according to claim 5 wherein said projections comprise straight lugs.

7. A lifting wall according to claim 5 wherein each of said slots is open at one end thereof.

8. A lifting wall according to claim 1 wherein said second mounting means comprises a guide slot in each of said discs and a pair of projections on each of said blades, one of said projections extending into the slot in one of said discs and the other of said projections extending into the slot of the other of said discs, each of said slots being longer than the associated projection.

9. A lifting wall according to claim 8 wherein said slots are opposite one another.

10. A lifting wall according to claim 8 wherein one of said projections has a shoulder engageable with the associated disc adjacent the associated slot.

11. A lifting wall according to claim 1 wherein each of said discs comprises a plurality of uniform segments joined to one another.

12. A lifting wall according to claim 11 wherein said first mounting means and said second mounting means for each blade are disposed on the longitudinal axis of a segment.

* * * * *